United States Patent [19]

Mullich

[11] 4,345,449

[45] Aug. 24, 1982

[54] HIGH SECURITY CYLINDRICAL BORED LOCK

[75] Inventor: Richard O. Mullich, Burbank, Calif.

[73] Assignee: TRE Corporation, Beverly Hills, Calif.

[21] Appl. No.: 104,299

[22] Filed: Dec. 17, 1979

[51] Int. Cl.[3] ..... E05B 55/00

[52] U.S. Cl. ..... 70/153; 70/484

[58] Field of Search ..... 70/153, 475, 478, 484, 70/107-111

[56] References Cited

U.S. PATENT DOCUMENTS

| | | | |
|---|---|---|---|
| 1,735,914 | 11/1929 | Wread | 70/153 |
| 3,910,613 | 10/1975 | Nolin | 70/107 X |
| 3,999,789 | 12/1976 | Maurits et al. | 70/107 X |
| 4,156,541 | 5/1979 | Babb, Jr. et al. | 70/108 X |

*Primary Examiner*—William E. Lyddane

*Attorney, Agent, or Firm*—Spensley, Horn, Jubas & Lubitz

[57] ABSTRACT

A lock employing a lock cylinder protected by an outer escutcheon and positioned coaxially with a lock control mechanism and an inner doorknob. An outer doorknob is supported by the outer escutcheon and mounted on an axis which is offset with respect to the axis of the lock cylinder and inner doorknob. A cam and pushrod arrangement is utilized to transfer rotation of the outer knob to the lock mechanism. The encasing of the lock cylinder within the outer escutcheon instead of the outer knob increases the security of the device by making it more difficult to tamper with the lock cylinder. In addition, slight modifications prevent the application of excess torque to the outer knob from releasing the lock mechanism.

9 Claims, 5 Drawing Figures

HIGH SECURITY CYLINDRICAL BORED LOCK

BACKGROUND OF THE INVENTION

1. Field of the Invention

This invention relates to lock mechanisms for doors. More particularly, this invention relates to lock mechanisms which utilize cylindrical bored lock sets.

2. Description of the Prior Art

In a typical cylindrical or bored lock system (shown in drawing FIG. 1) the lock cylinder is generally enclosed and protected by the outer grip knob of the lock set. The outer and inner grip knobs are coaxially mounted to spindles which are connected to a mechanism that resists knob rotation when the lock controls are set in the locked position. The spindles interact with a latch retractor, and rotation of the spindles when the lock is unlocked will impart transverse motion to the lock retractor, which in turn retracts the latch bolt of the assembly.

The conventional cylindrical lock mechanism has several disadvantages which limit its usefulness in areas having high security requirements. Initially, since the lock cylinder is contained within the outer doorknob, it is subject to easy manipulation. A vandal simply has to remove the doorknob in order to expose the latch retracting mechanism. This mechanism may then be easily manipulated with a common tool such as a screwdriver. Manipulation of the latch retracting mechanism enables the latch bolt to be retracted. In addition, removal of the lock cylinder and cylinder spindle permits direct manipulation of the latch retractor and withdrawal of the latch bolt.

An additional problem with lock mechanisms of the above described type is that it is usually possible to apply sufficient torque through the outside grip knob to cause failure of a lock tab which prevents rotation of the outside knob when the lock controls are set in the locked position. Upon failure of the lock tab, the outside grip knob may be rotated until retraction of the latch bolt has been accomplished.

Because of the above described security problems with cylindrical bored locks, most high security installations utilize lock mechanisms which incorporate some type of deadbolt arrangement in addition to the normal latch bolt. Although these types of locks provide high security, they are also complex and therefore usually relatively expensive.

One deadbolt arrangement is disclosed in U.S. Pat. No. 3,990,277 assigned to the same assignee as the present invention. This mechanism incorporates an exterior knob which is offset from the interior knob. Such an arrangement permits a mechanism to be used which decouples the exterior knob from the interior knob when the lock is engaged.

In a cylindrical bored lock, a deadbolt is often not employed and it becomes very important to protect the lock cylinder from tampering. It is therefore a primary object of the present invention to provide a cylindrical bored lock assembly which guards the lock cylinder and resists tampering.

It is another object of the present invention to achieve a cylindrical bored lockset which approaches deadbolt systems in terms of security but is much simpler and less expensive than such systems.

SUMMARY OF THE INVENTION

The present invention is directed to the modification of a conventional cylindrical lock mechanism which results in a high security lock. The lock cylinder and interior knob are mounted coaxially, and an outer escutcheon covers the lock cylinder so as to protect it against tampering. The outer doorknob is mounted on the outer escutcheon and is offset from the axis of the lock cylinder and inner doorknob. A first cam is included on the cylinder spindle and a second cam is attached to the mounting spindle of the outer doorknob. A pair of pushrods couple the cams to one another so that when the outer doorknob is rotated, the second cam will also rotate, causing the pushrods to move longitudinally. The pushrods will contact the first cam and cause it to rotate which in turn causes rotation of the cylinder spindle and retraction of the latch bolt. By utilizing such an arrangement, removal of the outer doorknob will not expose the lock cylinder or latch retracting mechanism thus preventing unauthorized entry.

In order to prevent the use of excessive torque from breaking the lock mechanism and allowing retraction of the latch bolt, the pushrods may be designed so that they will fail before the lock mechanism. Thus, security problems associated with both removal of the outside doorknob and the application of excessive torque to the outside doorknob are eliminated.

In an alternate embodiment, instead of designing the pushrods to fail before the lock mechanism, the excessive torque problem may be eliminated by designing the lock mechanism so that when it is locked, the first cam will be longitudinally moved so that it will not be contacted by the pushrods upon turning of the outer knob. By decoupling the pushrods from the first cam, rotation of the outer knob will not result in any movement of the first cam and the latch bolt will therefore remain locked.

DESCRIPTION OF THE PREFERRED EMBODIMENTS

Figure 1:
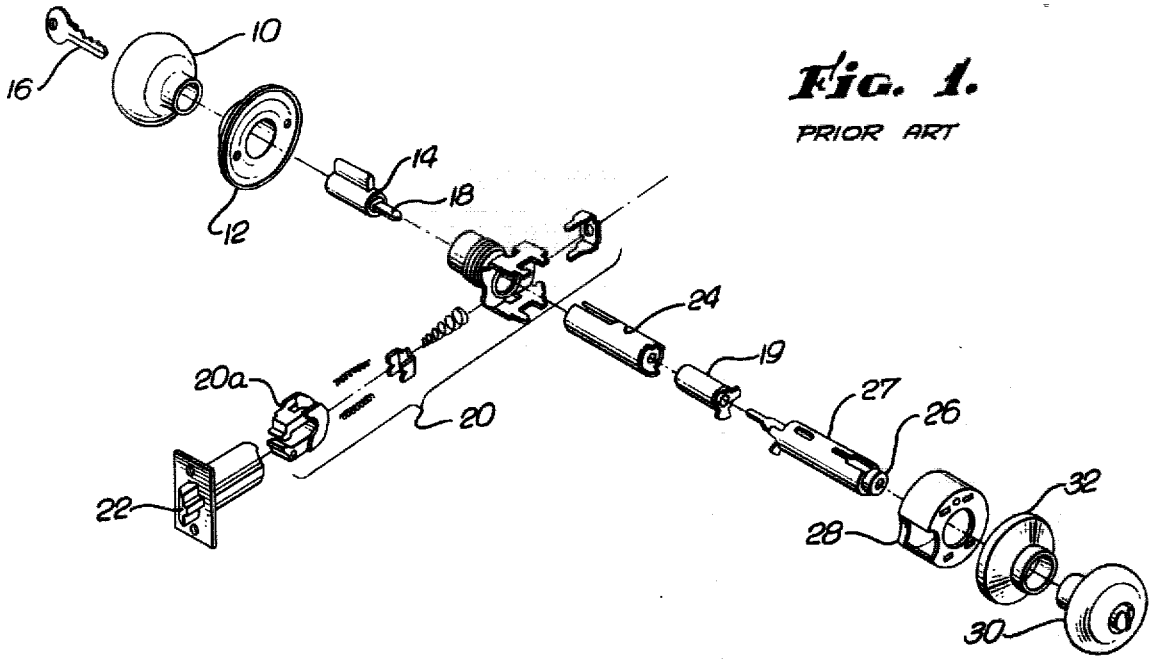
FIG. 1. PRIOR ART
FIG. 1 is an exploded perspective view of a typical prior art cylindrical bored lock mechanism.

Referring to FIG. 1, a typical prior art cylindrical bored lock and latch mechanism is shown. The mechanism includes an outer knob 10 and an outer escutcheon 12. A lock cylinder 14 is carried within the outer knob 10. A key 16 is insertable into the lock cylinder 14 through an opening in the front of the outer knob 10. Operation of the key 16 will cause rotation of a tail piece 18 of the lock cylinder 14. The tail piece 18 interconnects with a cylinder spindle 19 which interacts with a latch retraction assembly 20. Rotation of the tail piece 18 by means of the key 16 will cause the latch retractor assembly 20 to retract a latch bolt 22. An outer spindle 24 is connected to the outer knob 10 and surrounds the cylinder spindle 19. The outer spindle 24 is interconnected with the latch retractor assembly 20 so that rotation of the outer spindle 24 will also cause the latch bolt 22 to be retracted. A lock control 26 prevents rotation of the outer spindle 24 when it is in a locked position. A cover 28 fits over the latch retractor assembly 20, outer spindle 24 and the lock control 26. An inner knob 30 is supported by an inner escutcheon 32 and is connected to the outer spindle 24. The outer knob 10 is also connected to the outer spindle 24.

In normal operation, when the lock control 26 of FIG. 1 is in an unlocked position, rotation of either the outer knob 10 or inner knob 30 will cause rotation of the outer spindle 24 or inner spindle 27 and therefore retraction of the latch bolt 22. When the lock control 26 is in its locked position, however, rotation of the outer spindle 24 by means of the outer knob 10 is prevented. In this case, the mechanism may be operated only be means of the key 16 or by rotation of inner knob 30. It should be recognized that the mechanism described in FIG. 1 is but one of several variations which may be used. For example, the mechanism may be designed so that when a lock control is in a locked position, the latch bolt 22 may be retracted only by operating the key 16 (i.e., rotation of the inner knob 30 is prevented as well as rotation of the outer knob 10). A detailed description of the precise operation of the lock mechanism of FIG. 1 need not be given here, since it is but one of several different arrangements which are used with conventional cylindrical lock mechanisms. The present invention is directed to a modification of a standard cylindrical lock mechanism, and the mechanism of FIG. 1 is described for illustrative purposes only.

Since the lock cylinder 14 in the mechanism of FIG. 1 is carried within the outer knob 10, removal of the outer knob 10 by the application of external force will expose the cylinder spindle 19. The cylinder spindle 19 may then be manipulated to cause retraction of the latch bolt 22. In addition, the application of excessive torque to the outer knob 10 can result in failure of the lock control 26, which would then permit rotation of the outer spindle 24 and withdrawal of the latch bolt 22. The present invention eliminates these potential hazards.

Figure 2:
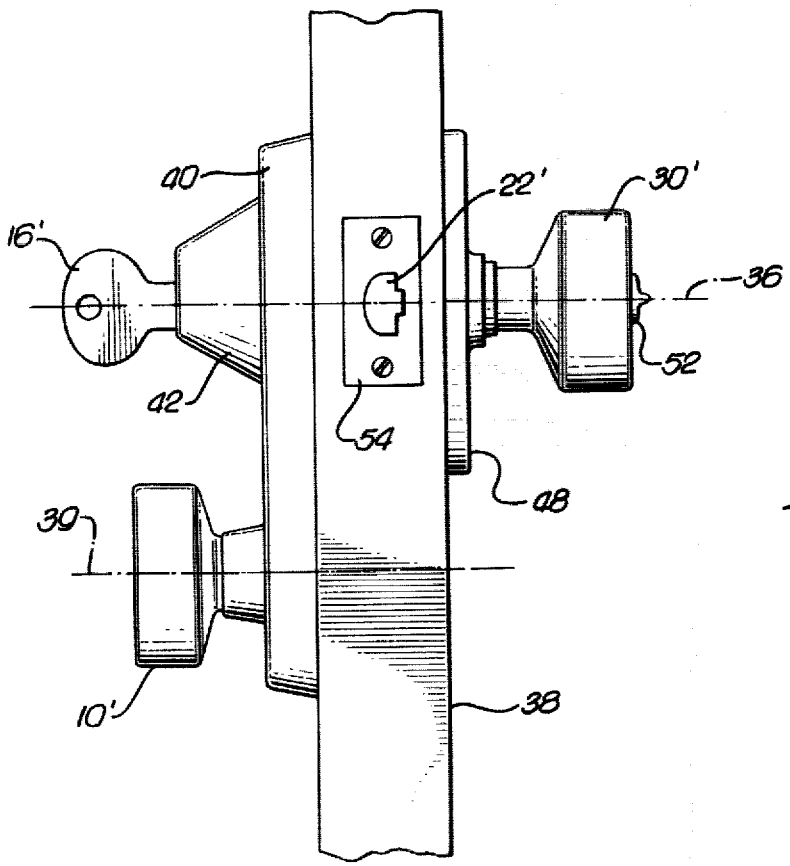
FIG. 2 is a side plan view of the lock mechanism of the present invention shown mounted in a door.

As shown in FIG. 2, the present invention includes an outer escutcheon 40 which has an integral outer protrusion 42 and supports an outer knob 10' below the protrusion 42. For purposes of clarity, elements shown in FIGS. 2–5 which correspond to elements of FIG. 1 are labeled with a prime. The outer escutcheon 40 is secured to a door 38. A key 16' fits in an opening (not shown) in the front of the outer protrusion 42. Mounted on the opposite side of the door 38 is an inner escutcheon 48 through which passes an inner knob 30'. A lock control button 52 extends from the inner knob 30'. A latch bolt 22' extends outwardly from the edge of the door 38 and is surrounded by a latch face 54. The inner knob 30', latch bolt 22' and key 16' all lie on a common axis 36. The outer knob 10' lies on an axis 39 which is offset with respect to the axis 36.

Figure 3:
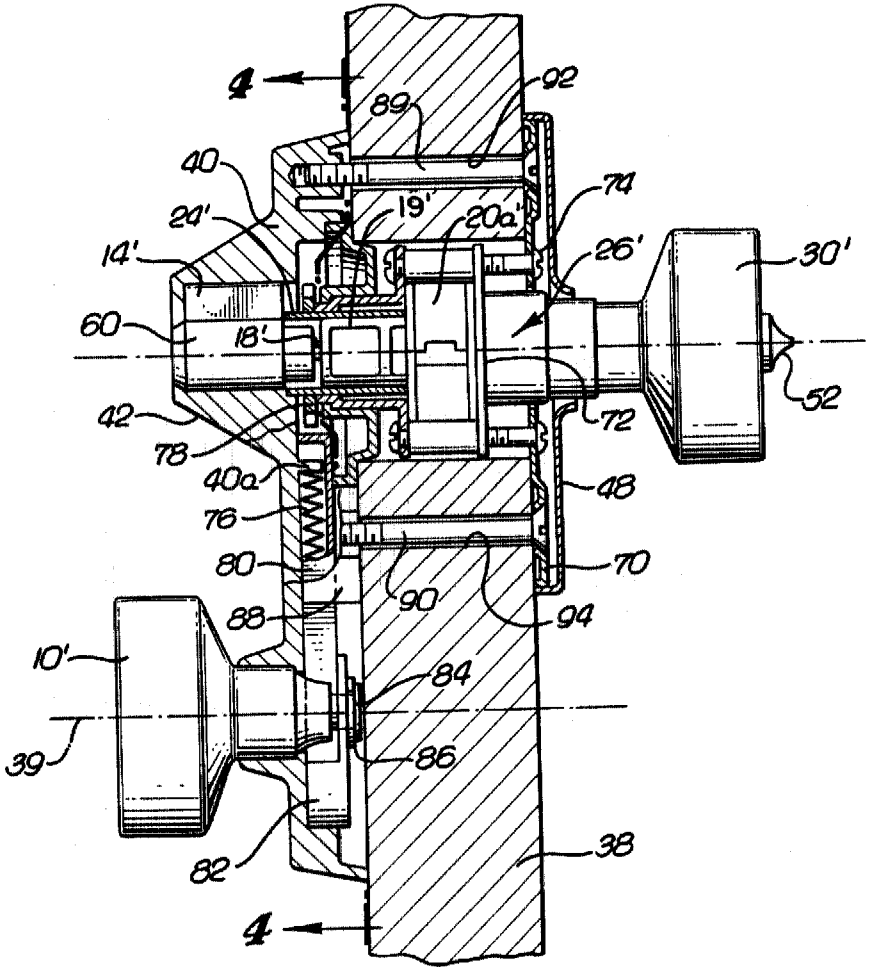
FIG. 3 is a side plan view in section of the lock mechanism of the present invention.

Referring now to FIG. 3, a lock cylinder assembly 14' is carried within the outer protrusion 42 of the escutcheon 40 in order to resist tampering. The lock cylinder assembly 14' includes a cylinder key core 60 which is exposed though the opening in the outer protrusion 42 and into which the key 16' is inserted. Rotation of the key 16' will cause rotation of a tail piece portion 18' of the lock cylinder assembly 14'. The tail piece 18' is coupled to a cylinder spindle 19', and rotation of the tail piece 18' will cause rotation of the cylinder spindle 19' which in turn causes retraction of a latch retractor 20a' or release of a lock mechanism 26', depending upon the particular design utilized.

Located within the inner escutcheon 48 is a support plate 70 to which is secured a housing 72 by means of screws 74. The housing 72 supports an outer spindle 24'. The cylinder spindle 19' is carried within the outer spindle 24'. An upper cam 78 is secured to the outer spindle 24' by welding or otherwise and rotation of the cam 78 will cause rotation of the outer spindle 24', which in turn will cause retraction of the latch retractor 20a'. When the lock mechanism 26' is locked, rotation of the outer spindle 24' is prevented. The upper cam 78 is actuated by means of a pair of pushrods 80 which extend vertically downward from the cam 78. The pushrods 80 cooperate with a lower cam 82 which is attached to a spindle 84 of the outer grip knob 10'. The cam 82 and knob 10' are held in position by a spindle retainer 86 which fits around the spindle 84.

Figure 4:
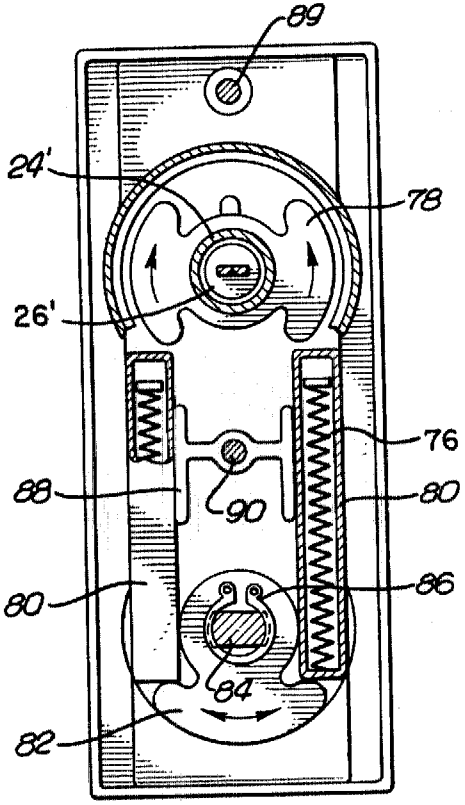
FIG. 4 is a plan view of a portion of the lock mechanism of the present invention taken along line 4—4 of FIG. 3.

Referring now to FIG. 4, the operation of the inventive portion of the locking mechanism will be described. A positioning bracket 88 serves to accurately position the pushrods 80 within the outer escutcheon 40, permitting them to move only in the vertical direction. When the outer grip knob 10' is rotated, the lower cam 82 will in turn rotate and will raise one of the pushrods 80. The raised pushrod 80 will contact the upper cam 78, causing it to rotate and in turn rotate the outer spindle 24'. The rotation of the outer spindle 24' will cause retraction of the latch retractor 20a' and the latch bolt 22'. A pair of springs 76 are biased between an extension 40a of the outer escutcheon 40 and an end of the pushrods 80, and serve to return the pushrods 80 to their original position. When the locking mechanism 26' is in a locked position, the outer spindle 24' will be prevented from rotating. This in turn restricts rotation of the outer grip knob 10'.

By modifying the design of a conventional cylindrical lock mechanism in the manner described above so that the lock cylinder and inner knob are located on an axis which is offset from the axis of the outer knob 10', the security of the lock mechanism is greatly increased. Since the lock cylinder 14' is not carried within the outer knob 10', removal of the knob 10' will not expose the lock cylinder 14' to tampering. In addition, the protruding portion 42 of the escutcheon 40 can be reinforced in order to make it more difficult to gain access to the lock cylinder 14'.

Although the above described design is still subject to the potential problem of breaking the lock mechanism 26' by the application of excess torque to the outer knob 10', a feature which also eliminates this problem may be easily incorporated. Simply by designing the pushrods 80 so that they will will fail before the lock mechanism 26' (i.e., by making them structurally weaker than the lock mechanism 26'), the application of excess torque to the outer knob 10' will cause failure of the pushrods 80 and the lock mechanism 26' will remain intact. This may be accomplished, for example, by making the pushrods 80 of plastic or zinc. Although the pushrods 80 will have to be replaced, the latch bolt 22' will remain extended and the door 38 will thus remain locked.

The locking mechanism of the present invention may be further strengthened by the addition of a pair of screws 89 and 90 (FIG. 3) which are used to secure the support plate 70 to the outer escutcheon 40. The only change over a normal lock mounting is that the requirement that two additional holes 92 and 94 be drilled in the door 38. As well as securing the outer escutcheon 40 to the support plate 70, the lower screw 90 also functions to position the bracket 88 within the escutcheon 40.

Figure 5:
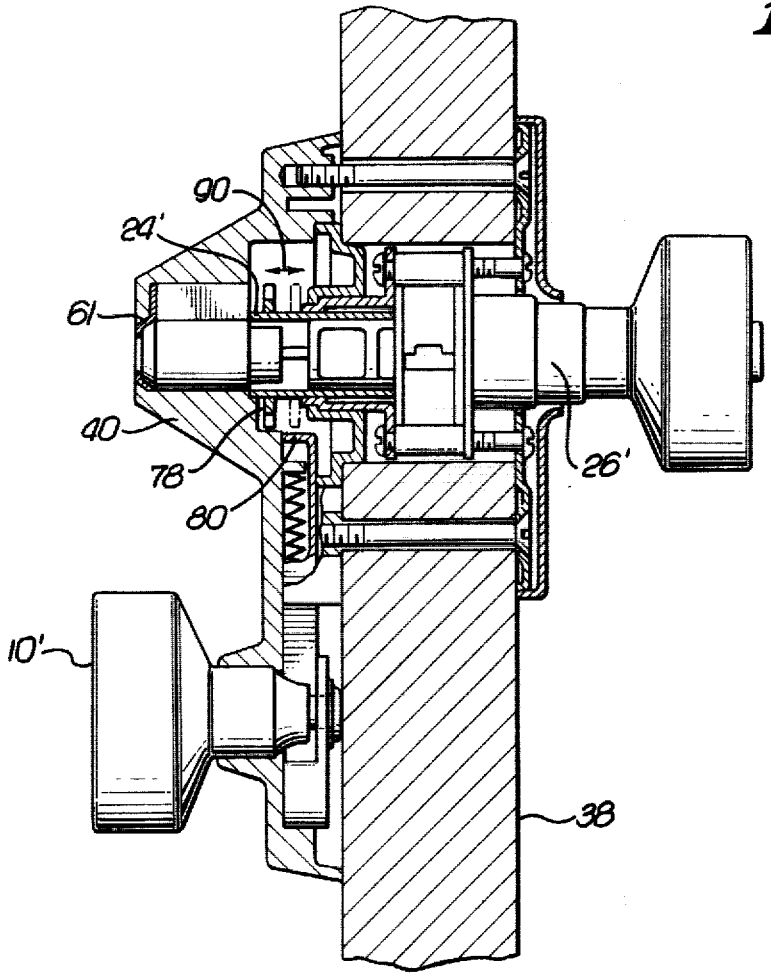
FIG. 5 is a side plan view of an alternate embodiment of the lock mechanism of the present invention.

Referring now to FIG. 5, an alternate means of solving the problem of the application of excess torque to the outer knob 10' is shown. In this embodiment, the locking mechanism 68 is designed so that when it is locked, the outer spindle 24', and therefore the upper cam 78, will be longitudinally moved as shown by arrow 90 so that it will be out of the path of the pushrods 80. When this is done, the rotation of the outer knob 10' will have no effect upon the locking mechanism 26' since it will not contact any portion of it. When the locking mechanism 26' is returned to its unlocked position, the upper cam 78 will be moved back into a position where it will be contacted by the pushrods 80 when the knob 10' is rotated. Also, as shown in FIG. 5, the key core 60 may be covered with a hardened steel cap 61 to resist drilling of pins within the key core 60.

Although it is most convenient to mount the cam and pushrod mechanism between the outer escutcheon 40 and the door 38, the mechanism could be mounted within the door 38 itself. Although this might provide marginally increased security, it would require an additional opening to be formed in the door beyond the standard opening which the preferred embodiment utilizes.

In summary, the present invention is directed to an improved cylindrical lock mechanism which has increased security compared to a normal common axis cylindrical lock and yet is simple enough so that its cost will be significantly less than typical high security deadbolt lock mechanisms. The invention can be easily adapted to operate with various types of cylindrical lock mechanisms as long as they depend upon the rotation of a spindle for their operation. The basic design of the lock provides protection against tampering with the lock cylinder by positioning the lock cylinder away from the outer knob. With slight modifications, the mechanism will also prevent the application of excess torque to the outer knob from releasing the lock mechanism.

I claim:

1. An offset knob security assembly for use with a cylindrical bored lock of the type having a lock cylinder which cooperates with a cylinder spindle to retract a latch bolt and an outer spindle surrounding the cylinder spindle, said outer spindle cooperating with an inner knob to also retract said latch bolt, wherein said lock cylinder, cylinder spindle, outer spindle and inner knob are located on a first axis, said security assembly comprising:

an outer knob located on a second axis which is offset from said first axis;

a first cam connected to the outer spindle;

a second cam connected to the outer knob; and a pair of parallel pushrods coupling the second cam to the first cam, whereby rotation of said outer knob will rotate said second cam and impart rotation to first cam and outer spindle through one of said pushrods, wherein the offset arrangement between the outer knob and the lock cylinder and cylinder spindles isolates the lock cylinder and spindles from outside manipulation despite removal of the outer knob.

2. The security assembly of claim 1 wherein the first cam is longitudinally movable from a first position in which it is in contact with the pushrods to a second position in which it is decoupled from the pushrods, said decoupling further increasing the security of the assembly.

3. In a cylindrical bored lock mechanism of the type including a latch retractor, an inner knob, a key actuated lock cylinder coaxial with the inner knob, an inner spindle coaxial with and rotated by the lock cylinder, an outer spindle coaxial with and rotated by the inner knob, whereby rotation of either the inner or outer spindle will cause retraction of the latch retractor, and a locking device cooperating with the outer spindle for preventing retraction of the latch retractor, the improvement for increasing the security of the lock mechanism comprising:

a first cam attached to the outer spindle;

an outer escutcheon covering the lock cylinder;

an outer knob located in an opening of the outer escutcheon on an axis which is offset from the axis of the lock cylinder;

a second cam connected to the outer knob within the outer escutcheon; and a pair of parallel pushrods located within the outer escutcheon and coupling the first cam to the second cam, whereby rotation of the outer know will rotate the second cam and impart rotation to the first cam and other spindle via said pushrods, wherein the offset arangement between the outer knob and the lock cylinder and spindles isolates the lock cylinder and spindles from outside manipulation despite removal of the outer knob.

4. The lock mechanism of claim 1 or 3 wherein:

said first cam includes a central portion connected to said outer spindle and right and left horizontal portions extending from each side of the central portion, wherein the top of one pushrod cooperates with said right horizontal portion and the top of the other pushrod cooperates with the left horizontal portion; and said second cam includes a central portion connected to the outer knob and a lower portion extending from the central portion, said lower portion including a right extension which cooperates with one of the pushrods and a left extension which cooperates with the other pushrod.

5. The lock mechanism of claim 3 further including an inner escutcheon carrying said interior knob and at least one screw, having a length sufficient to pass through a door, securing said inner escutcheon to said outer escutcheon, thereby increasing the security of said lock mechanism.

6. The lock mechanism of claim 3 wherein said locking device operates to prevent rotation of the outer spindle and wherein the pushrods are structurally weaker than the locking device, whereby the application of excessive torque to the outer knob when the locking device is locked will cause failure of the pushrods instead of the locking device.

7. The lock mechanism of claim 6 wherein said pushrods are made of plastic.

8. The lock mechanism of claim 7 wherein said inner escutcheon is secured to said outer escutcheon by a pair of screws.

9. The lock mechanism of claim 6 wherein said pushrods are made of zinc.

* * * * *